United States Patent [19]

Lenertz

[11] Patent Number: 4,463,787

[45] Date of Patent: Aug. 7, 1984

[54] ELECTRIC LOG SPLITTER

[75] Inventor: John I. Lenertz, Brainerd, Minn.

[73] Assignee: Yukon Energy Corporation, Minneapolis, Minn.

[21] Appl. No.: 297,111

[22] Filed: Aug. 28, 1981

[51] Int. Cl.[3] ..... B27L 7/00

[52] U.S. Cl. ..... 144/193 R; 74/11; 74/63; 144/366

[58] Field of Search ..... 144/193 R, 193 K, 366; 74/11, 63

[56] References Cited

U.S. PATENT DOCUMENTS

| | | | |
|---|---|---|---|
| 1,283,195 | 10/1918 | Hunter . | |
| 2,851,072 | 9/1958 | Gerjets et al. | 144/193 |
| 4,066,110 | 1/1978 | Sarno | 144/193 A |
| 4,076,062 | 2/1978 | Kanik | 144/193 A |
| 4,116,251 | 9/1978 | Graney | 144/193 R |
| 4,121,636 | 10/1978 | James | 144/193 R |
| 4,141,395 | 2/1979 | Arzt | 144/193 R |
| 4,223,707 | 9/1980 | Jensen et al. | 144/193 R |
| 4,293,013 | 10/1981 | Phelps et al. | 144/193 A |

FOREIGN PATENT DOCUMENTS

| | | | |
|---|---|---|---|
| 3028261 | 3/1982 | Fed. Rep. of Germany | 144/193 A |
| 231752 | 4/1944 | Switzerland | 144/193 R |

*Primary Examiner*—W. D. Bray

*Attorney, Agent, or Firm*—Kinney & Lange

[57] ABSTRACT

A log splitter is electrically powered and is portable in that it can be disassembled in discrete components for transportation in a car trunk. The splitter is rapidly operable, and is safe to operate, besides being highly portable and easy to use in remote places.

6 Claims, 10 Drawing Figures

ELECTRIC LOG SPLITTER

BACKGROUND OF THE INVENTION

1. Field of the Invention

The present invention relates to log splitters which are driven by electrical power and are capable of being broken down into sections for transport.

2. Description of the Prior Art

In the prior art, log splitters have been gaining popularity in use because many people are using wood as a fuel.

U.S. Pat. No. 4,121,636 shows a small log splitter that uses a power head of a chain saw and has a screw actuator where the screw rotates and the splitting wedge itself moves along the screw. The screw is driven through a bevel gear drive from the chain saw motor.

A conventional or standard log splitter is shown in U.S. Pat. No. 4,076,062 which shows a power package for driving a hydraulic pump and then uses the pump for running a hydraulic cylinder for operating the splitter.

U.S. Pat. No. 4,141,395 shows a double screw log splitter that is driven through the use of an automobile wheel which rotates a pair of friction drums 48 and 50 shown in the patent. A ramp is provided so that the rear wheels of a vehicle such as a pickup truck can be backed up on the ramp and positioned in between the two drums.

A fixed wedge is shown in U.S. Pat. No. 4,141,395 and also in U.S. Pat. No. 4,076,062.

An electric motor used for driving a hydraulic pump in a wood splitting machine is shown in U.S. Pat. No. 2,851,072 and U.S. Pat. No. 4,223,707 shows a wheel mounted log splitter utilizing a traveling nut on a screw wherein the screw is driven by an internal combustion engine.

U.S. Pat. No. 1,283,195 shows a longitudinally moving screw driving a log splitter wedge. The patent shows a substantially different type of device different from the log splitter of the present invention but it does include a wedge 8 that is driven with a rotating nut moving a screw 10 longitudinally for the splitting action.

A rack and pinion driven log splitter is shown in U.S. Pat. No. 4,116,251. Another hydraulically powered log splitter using an internal combustion engine as the power source is shown in U.S. Pat. No. 4,066,110.

SUMMARY OF THE INVENTION

A log splitter that is portable in the sense that it can be broken down into three components which can in turn be inserted into the trunk of an automobile transported to a remote location and reassembled for use. The log splitter utilizes a direct current electric motor which operates from a battery. One of the components may include a battery pack so that the unit is self contained when assembled.

The log splitter operates with a movable screw drive that operates a pusher that forces a log or piece of wood against a splitting wedge. The screw is operated by rotating a low friction recirculating ball type nut, which is driven by a chain and sprocket through a gear box from the electric motor.

The screw is easily protected as it travels relative to the nut as it moves the pusher toward and away from the splitting wedge. Further, the unit is easily disassembled and can be used with either high speed or low speed wheels or supports.

A high performance marine battery can be used as a power source and will operate the log splitter for several hours, or in other words substantially a full working day.

DETAILED DESCRIPTION OF THE PREFERRED EMBODIMENTS

Figure 1:
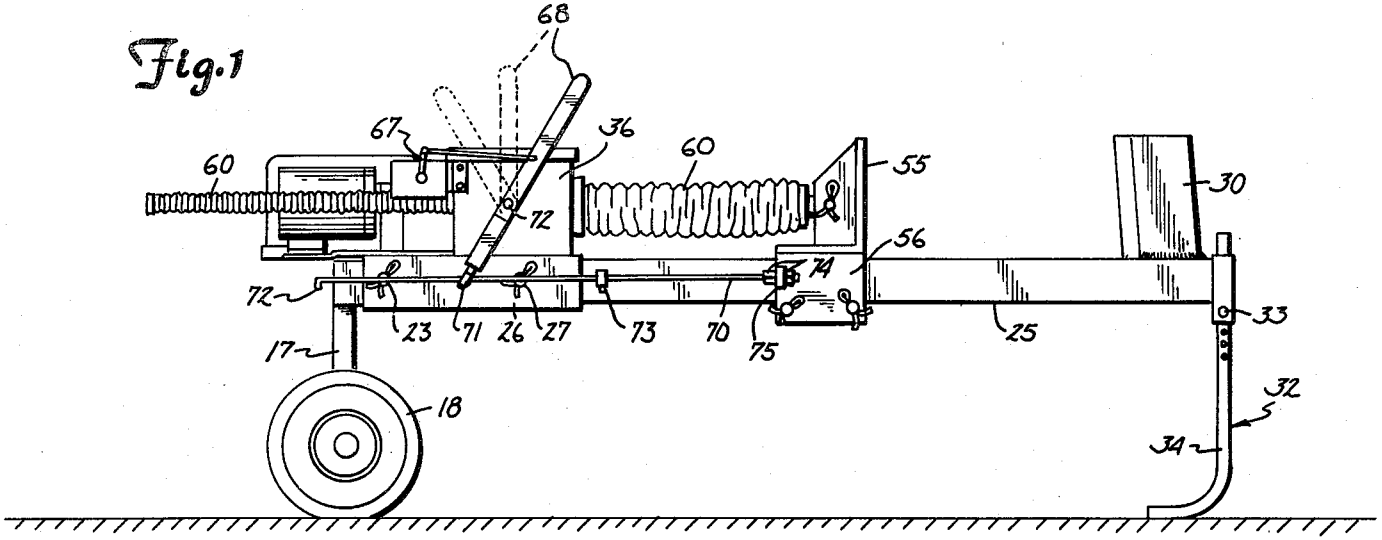
FIG. 1 is a side elevational view of a log splitter made according to the present invention.
Figure 2:
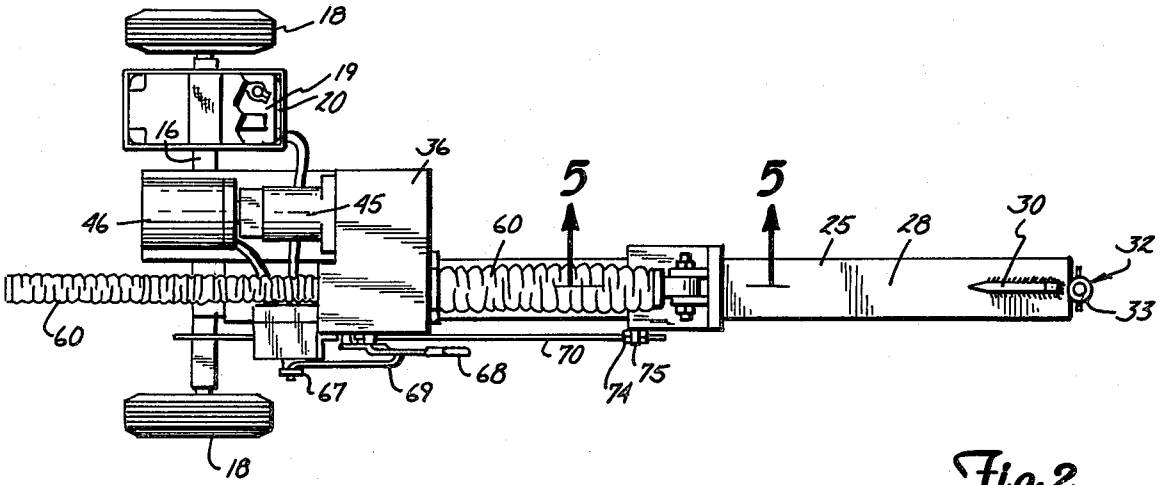
FIG. 2 is a top plan view thereof.
Figures 8, 9, 10:
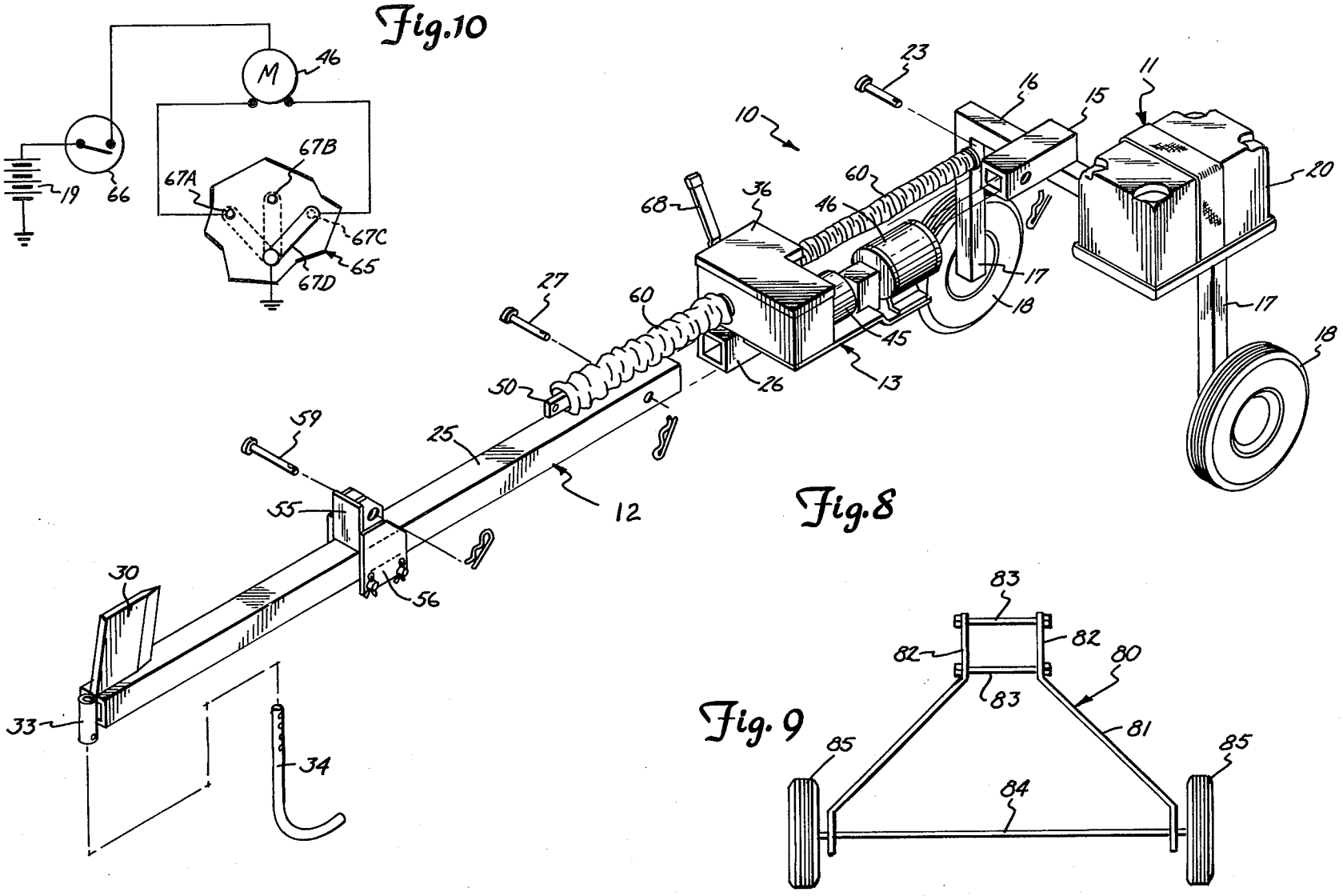
FIG. 8 is an exploded perspective view of the log splitter of the present invention showing the log splitter's major components.
FIG. 9 is an end view of a set of wheels for use where a separate power source is used.
FIG. 10 is a simplified schematic representation of an electric circuit used to control the log splitter.

The log splitter of the present invention is indicated at 10, and is shown in FIGS. 1 and 2 in complete assembly and in FIG. 8 is taken apart. The log splitter 10, as shown in FIG. 8 is made up of three distinct major components including a wheel assembly 11, an elongated frame member and splitting wedge assembly 12, and a drive unit of power package 13 which forms a basic support to hold the parts together.

The wheel assembly 11 includes a frame support tongue 15, a cross support 16, and vertical uprights 17,17 fixed to cross support 16 on which wheels 18 are rotatably mounted. The cross support 16 has a battery case 20 mounted on one end thereof adjacent one of the wheels 18. The battery case is used for holding a battery 19 that provides the power supply for the unit. The frame support tongue 15 is a square tubular member that fits within a sleeve 26 (also a square tube) of the drive unit or power package. A cross pin 23 is passed through the frame support tongue 15 and through the side walls of the sleeve 26 to hold the frame support tongue in position within the sleeve and support the drive unit 13 through the frame and wheels.

The pin 23 is held in place with an ordinary safety clip, which is removed from the pin when the log splitter is to be disassembled. Once the pin 23 is removed of course the frame support tongue 15 can be pulled out of the sleeve 26 and the wheel assembly 11 then separates and can be transported and stored independently. The wheel assembly 11 is made so that it will fit into the truck of an average size automobile for easy portability.

Figure 6:
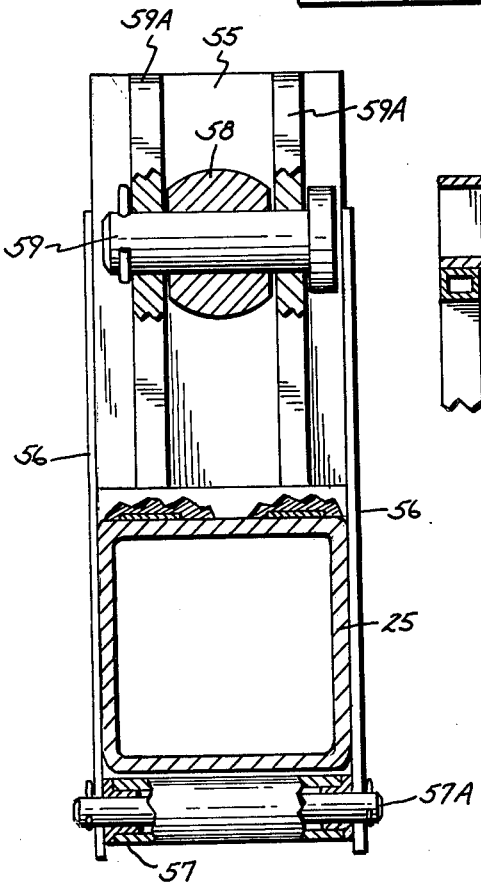
FIG. 6 is a sectional view taken as on line 6—6 in FIG. 5.

The wheels 18 as shown can be used for towing the unit if desired for at least short distances. The low speed wheels, with no battery case, as shown in FIG. 6 may be substituted for example if a separate battery from a vehicle is used.

The wheel assembly provides a stable support for the log splitter in the location of use.

The frame 12 as shown comprises an elongated frame member 25 which may be tubular as shown and which has an end portion that fits within the sleeve 26. The end portion of member 25 is held in place in sleeve 26 with a cross pin 27. The cross pin 27 can be removed to permit pulling the entire frame assembly 12 out of the sleeve 26 for disassembly. The frame member 25 has an upper wall 28 which is used, as will be explained, for guiding a log pusher. A splitting wedge 30 is fixed at one end of the frame member 25 opposite from the end that attaches to the sleeve 11. Note that the splitting wedge 30 has an undercut (negative rake) splitting edge to tend to force the logs down against the wall 27 when the logs are being split.

A removable and vertically adjustable stand indicated generally at 32 is provided at the outer end of the frame member 25 and includes a stand sleeve or housing 33 into which a telescoping support pole 34 can be mounted at selected heights by providing a series of apertures in the housing and in the support pole and passing a pin through desired aligning apertures. This will be used to level the frame member 25 when it is assembled as shown in FIG. 1.

Figure 3:
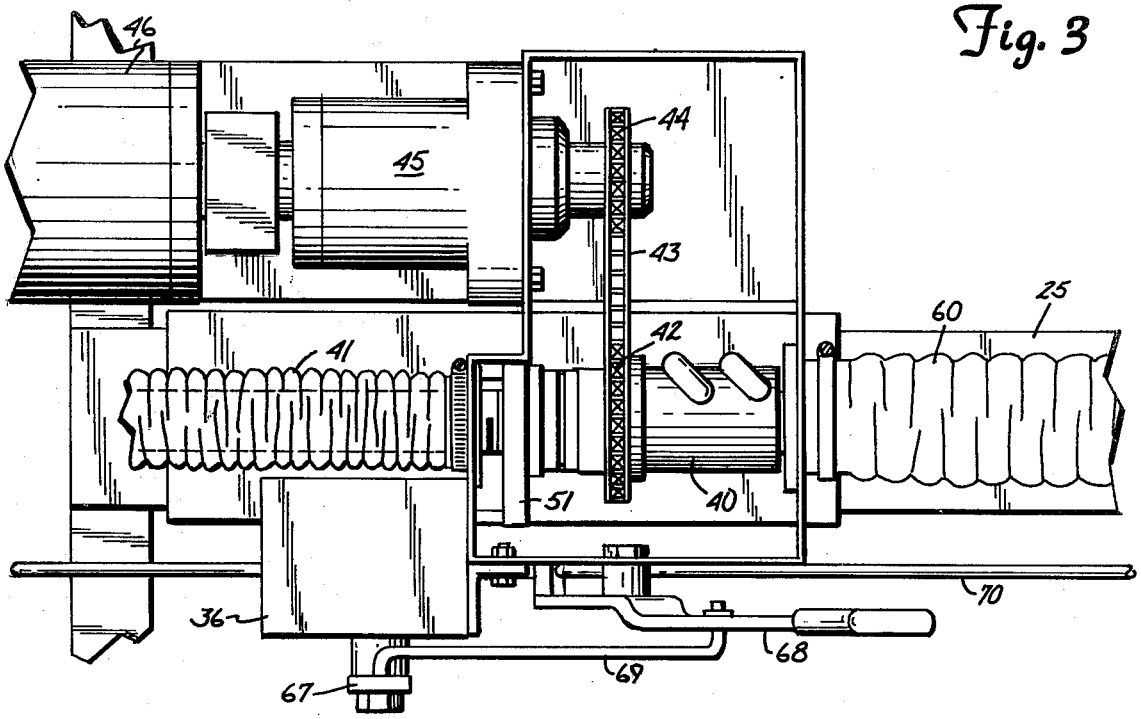
FIG. 3 is an enlarged top plan view illustrating a typical drive mechanism for the log splitter of the present invention.
Figure 4:
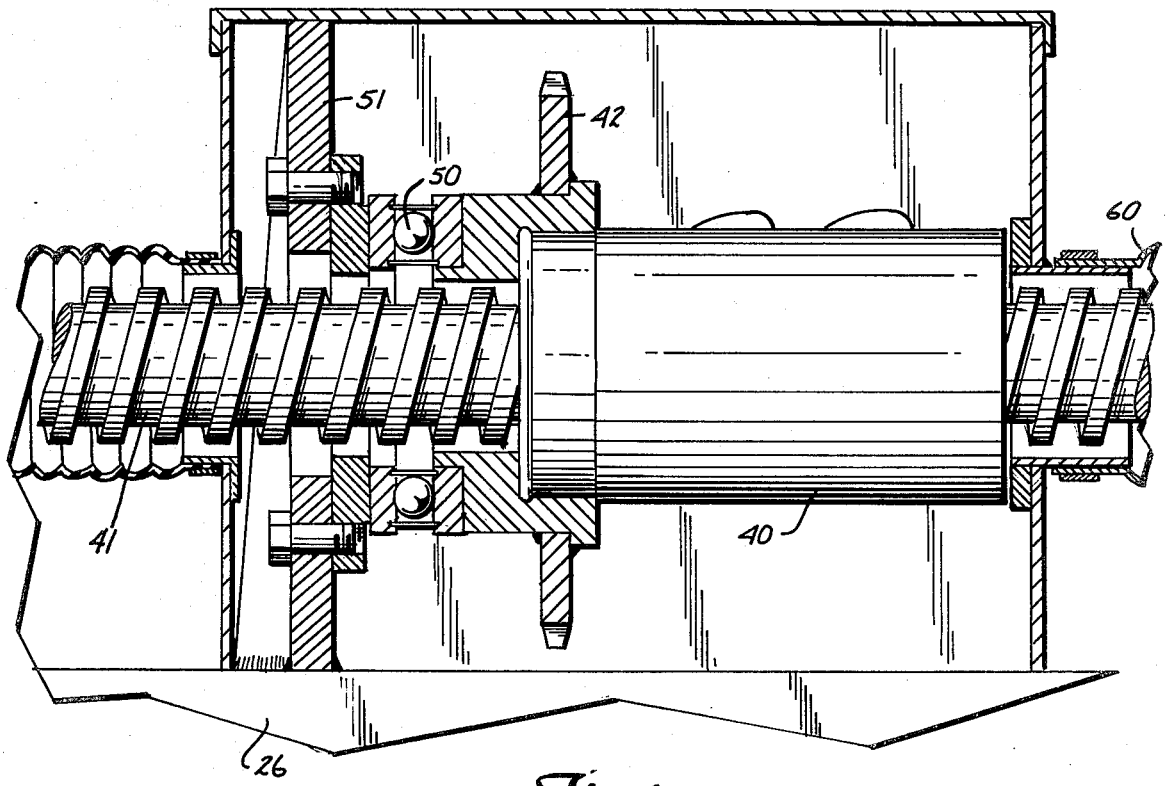
FIG. 4 is a sectional view taken as on line 4—4 in FIG. 3.
Figure 5:
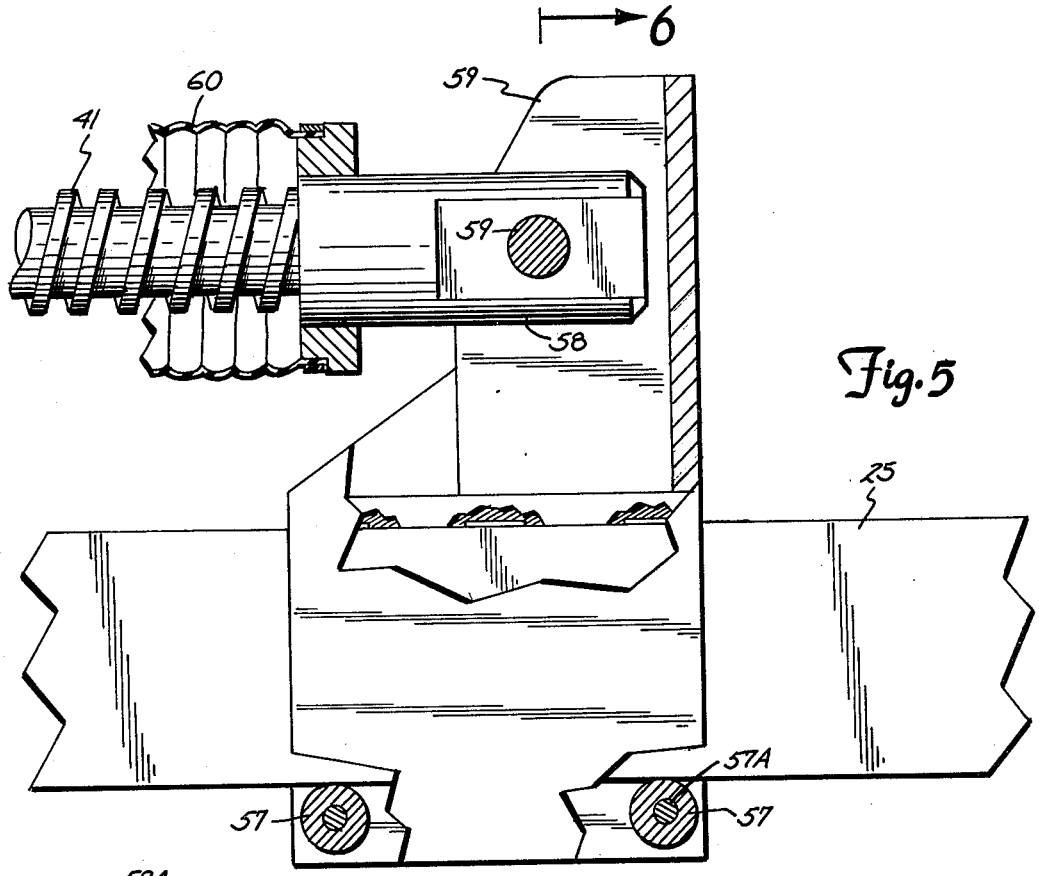
FIG. 5 is an enlarged sectional view taken as on line 5—5 in FIG. 2.

The drive unit or power package 13 includes a frame comprising the sleeve 26 and a drive support housing structure 36 mounted on the sleeve. The support housing structure 36 comprises a frame or box in which a recirculating ball nut indicated at 40 in FIG. 3 is rotatably mounted in a desired manner which is shown schematically. The ball nut surrounds a ball screw 41 that is of suitable length as will be explained. The ball nut 40 in turn is driven by the use of a sprocket 42 attached to the outer cover of the nut and is driven through a chain 43 from the output sprocket 44 of a gear reducer 45. The gear reducer 45 in turn is driven by an electric motor 46 which in the form of the invention disclosed is a reversible 12 volt DC motor, and which is selected to have a sufficient power to drive the gear box, sprocket 44, chain 43 and sprocket 42 to in turn drive the recirculating ball nut 40.

A thrust and support bearing 50 is provided between a rear wall 51 of the housing 36 and the sprocket 42 and this bearing carries the thrust and radial loads from the ball nut 40 when the screw 41 is being loaded to split a log. The nut 40 may be supported in any desired manner.

As can be seen, the screw 41 extends through the nut 40, and through the front and rear walls of the housing 36 and is supported in the ball nut 40. The screw has a pusher or ram head 55 at the outer end thereof and the ram head in turn has guide plates 56 which slidably mount along the outer sides of the frame 25. The ram head has guide rollers 57 on the lower side of the frame which are rotatably mounted on the outside of removable pins 57A. The ram head 55 can be slid along the frame member 25 for splitting logs and pushing the logs against the wedge 30. The screw 36 has an end ear 58 which is pinned to the ram head with a pin 59 between gusset supports 59A. The ball screw 41 extends out to the rear of the housing 36, as shown in FIGS. 1 and 2 for example. The screw 41 is of sufficient length so that it will extend from the nut 40 to position the pusher of ram head 55 adjacent to the wedge 30.

When retracted, the screw 41 moves back out to the rear of the housing 36 as the ram head 55 is retracted.

Recirculating ball nuts and ball screws are well known, and provide a very low friction, high force rotatably to linear converter and when the ball nut is rotated through the use of the chain and sprocket by driving the electric motor, sufficient force will be generated to split log sections. If desired, the screw could be rotated under power from the motor 46.

Flexible boots or covers 60 are provided over the ball screw at both ends to prevent dirt and grit from getting into the screw 41 and causing problems in operation.

Figure 7:
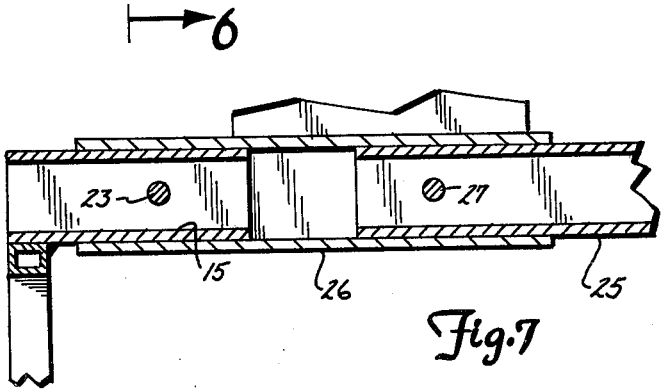
FIG. 7 is a sectional view showing the means of mounting the three major components of the log splitter as a unit.

The control switch assembly indicated at 65 (see also FIG. 10) includes a main on and off key operated switch 66 that controls power from the battery 19 and also has a lever control switch 67 that is pivotally mounted, and drives a switch finger 67D between forward, reverse, and off positions shown schematically at contacts 67A, 67B, and 67C in FIG. 7. The switch lever 67 and its connected switch finger 67D are controlled by a link 69 from a hand control lever 68 that is pivotally mounted as at 72 to the housing 36. The control lever 68 is positioned adjacent to the base end of the frame member 25 so that the control lever 68 can easily be reached when a log has been placed on top of the frame 25 after the ram head has been retracted. By moving the lever 68 to the solid line position as shown in FIG. 1, the lever 66 and the connected switch finger 67D in FIG. 7 are positioned so the motor 46 will be driven to force the ram head toward the wedge and force any log that is between the wedge and the ram head against the wedge.

The center position of the lever 68 and lever 66 is "off". That is, motor 46 is not powered, and the position shown in dotted lines to the left in FIG. 1 and to the left for finger 67D in FIG. 10 is the reverse or "retract" position, wherein the motor 46 is reversed to rotate the nut 40 and moves the ram head away from the wedge.

The control lever 68 can be quickly thrown to reverse position if something unwanted occurs, so that the ram head can be retracted quickly to avoid accidents and the like.

Positive mechanical control of the control lever 68 is provided for positive safe operation. A rod 70 is adjustably connected to an ear 75 of the ram head with a pair of nuts threaded on the rod on opposite sides of the ear 75 to hold the rod on the ram head. The rod 70 extends through an eyelet 71 on the lower end of the control lever 68. The opposite end of the rod 70 has a latch finger 72 that will trip control lever 68 and cause it to pivot to disable the power to the motor when the ram approaches the wedge 30.

With the control lever 68 in the "retract" position, which is the dotted position to the left in FIG. 1, an adjustable stop collar 73 on rod 70 may be positioned to engage the eyelet 71 to move the control lever 68 and switch lever 67 to the off position when the ram head has been retracted sufficiently.

The position of the ram head 55 in relation to the housing 36 can be adjusted through the use of the collar 73 on the rod 70.

The adjustment of the position where the splitting movement of the ram head toward the wedge is stopped is done only with lock nuts 74 where the rod passes through an opening in an ear 75 on the ram head. The latch finger 72 thus remains fixed to insure that the ram head does not engage the wedge.

As shown in FIG. 9, the low speed wheel set indicated at 80 can be utilized in place of the unit 11 where the battery is not needed for powering the DC motor 46. This can be done by connecting the motor 46 through suitable leads to the battery of a vehicle such as a car, or to a stationary power supply. The low speed wheels as shown include a pair of support struts 81,81 having upper end portions 82,82 which fit against the sides of sleeve 26, and cross bolts 83 can be postioned on the top and bottom of the sleeve 26 to hold the struts 81 in position.

A lower portion of the struts 81 can be held by a cross axle 84 on which wheels 85 are rotatably mounted in a desired manner. The low speed wheel set can reduce the cost, still gives supportability and ease of disassembly as previously described.

The safety features can all be built into the unit also as previously described to make sure that the motor does not continue to run to cause the ram head to damage the wedge, or retract the ram too far to that it would engage or damage the housing 36.

What is claimed is:

1. A log splitter assembly including an elongated frame, a splitting wedge mounted at one end of said frame, a ramhead movable along the longitudinal length of said frame, means to power said ramhead for movement along said frame including cooperating low friction threaded screw and nut members that upon rotation relative to each other cause longitudinal movement of said ramhead along said frame, reversible electric motor means for rotating one of said screw and nut members to linearly move one of the members and thus the ramhead, control means to selectively actuate said electric motor means in first and second directions of rotation to result in movement of said ramhead selectively toward or away from said wedge, and mechanical link means carried by said ramhead and engagable with said control means to move said control means to a position disabling said motor means when the ramhead is moved adjacent to said wedge.

2. The combination as specified in claim 1 wherein said mechanical link means is adjustable.

3. The apparatus as specified in claim 1 wherein said motor means, and said nut and screw form a drive unit, means to removably attach said ramhead and frame to said drive unit.

4. The apparatus as specified in claim 3 wherein said means to removably attach comprises a sleeve mounted on said drive unit, said frame having a portion that slips inside said sleeve, and removable pin means for pinning said sleeve and said frame together.

5. The apparatus as specified in claim 4 and a wheel support carriage mountable on said sleeve for supporting said drive unit and said frame in spaced relation to the ground.

6. The apparatus as specified in claim 5 and an adjustable support at an outer end of said frame adjacent said wedge to support the outer end of the frame spaced from a supported surface.

* * * * *